United States Patent [19]

Moustakas

[11] 4,127,271

[45] Nov. 28, 1978

[54] COMBINATION TOY TOP, PROJECTILE TOY AND BATH TOY

[75] Inventor: Matthew A. Moustakas, Mercerville, N.J.

[73] Assignee: CBS Inc., New York, N.Y.

[21] Appl. No.: 785,267

[22] Filed: Apr. 6, 1977

[51] Int. Cl.[2] ..... A63B 67/06

[52] U.S. Cl. ..... 273/100; 46/65; 46/91; 273/104; 273/105.2

[58] Field of Search ..... 273/95 R, 96 B, 97 A, 273/99, 100, 102 R, 102.4, 104, 105 R, 105 A, 106 R, 106 B, 142 R, 142 K, 105.2; 46/64, 65, 73, 91, 92

[56] References Cited

U.S. PATENT DOCUMENTS

| | | | |
|---|---|---|---|
| 685,311 | 10/1901 | Ward | 46/73 |
| 939,580 | 11/1909 | Young | 273/100 |
| 970,901 | 9/1910 | Ernst | 273/95 R |
| 1,032,336 | 7/1912 | Johnson | 273/96 R X |
| 1,115,938 | 11/1914 | Hobden | 273/100 UX |
| 1,705,501 | 3/1919 | Sas | 273/100 |
| 2,429,344 | 10/1947 | Cintron | 273/142 R |
| 2,950,114 | 8/1960 | Minetti | 273/99 |
| 3,103,362 | 9/1963 | Elofson | 273/105 R |
| 3,208,751 | 9/1965 | Kostka | 273/105 A X |

FOREIGN PATENT DOCUMENTS

| | | | |
|---|---|---|---|
| 459,373 | 9/1949 | Canada | 46/64 |
| 167,196 | 4/1934 | Switzerland | 273/104 |
| 190,896 | 1/1923 | United Kingdom | 46/64 |

OTHER PUBLICATIONS

Ideal Pool and Inflatables catalog, 1965.

*Primary Examiner*—William H. Grieb
*Attorney, Agent, or Firm*—Spencer E. Olson

[57] ABSTRACT

The disclosure is directed to a combination toy top, projectile toy, and bath toy. In accordance with one embodiment of the disclosed toy there is provided a cup-shaped receptacle having a tip protruding from the outer apex thereof and a central stem extending upwardly from the bottom inner surface thereof. The receptacle has a retaining rim extending inwardly from the inner surface thereof at about the periphery thereof. The rim preferably comprises a plurality of inwardly extending tabs. A plurality of projectiles are provided, the projectiles preferably being annular rings having a sufficiently small outer dimension to fit between the stem and the rim of the receptacle, and a sufficiently large central opening to fit over the stem. In play, the receptacle is held by the central stem and spun. Rings accurately tossed toward the receptacle are either captured in the region between the rim and the stem, or, if very accurately tossed, encircle the stem and are retained thereon. The rim keeps captured rings from flying out by action of centrifugal force. In an embodiment of the invention, at least one gap is provided between the inwardly extending tabs so that rings in particular positions within the receptacle will be ejected during the spinning thereof. This feature adds an element of chance to the game.

6 Claims, 2 Drawing Figures

COMBINATION TOY TOP, PROJECTILE TOY AND BATH TOY

BACKGROUND OF THE INVENTION

This invention relates to amusement devices and, more particularly, to a combination toy top, projectile game, and bath toy. The prior art contains various types of projectile games wherein projectiles are tossed toward either a stationary or moving target or receptacle with the objective of having the projectile land in a particular geometrical region. Examples are set forth in the U.S. Pat. Nos. 939,580, 970,901, 1,032,336, 1,115,938, 1,705,501, 2,429,344, 3,103,362 and 3,208,751. Most games of this type require a relatively large number of parts, some of which are movable, and this tends to render such games expensive and/or unreliable. The simpler games of this type, however, are not particularly versatile.

It is an object of the present invention to provide a toy which serves as a relatively inexpensive and sturdy projectile amusement device, and also can be used as a toy top and/or a bath toy.

SUMMARY OF THE INVENTION

The present invention is directed to a combination toy top, projectile toy and bath toy. In accordance with an embodiment of the invention, there is provided a cup-shaped receptacle having a tip protruding from the outer apex thereof and a central stem extending upwardly from the bottom inner surface thereof. The receptacle has a retaining rim extending inwardly from the inner surface thereof at about the periphery thereof. The rim preferably comprises a plurality of inwardly extending tabs. A plurality of projectiles are provided, the projectiles preferably being annular rings having a sufficiently small outer dimension to fit between the stem and the rim of the receptacle, and a sufficiently large central opening to fit over the stem.

In play, the receptacle is held by the central stem and spun. Rings accurately tossed toward the receptacle are either captured in the region between the rim and the stem, or, if very accurately tossed, encircle the stem and are retained thereon. The rim keeps captured rings from flying out by action of centrifugal force. In an embodiment of the invention, at least one gap is provided between the inwardly extending tabs so that rings in particular positions within the receptacle will be ejected during the spinning thereof. This feature adds an element of chance to the game.

In the preferred embodiment of the invention, the receptacle, flange, stem, and tabs are integrally formed of molded plastic. The plastic has a wall thickness which is sufficient to provide enough buoyancy to the receptacle such that it can spin freely while floating in water. Accordingly, the amusement device can be utilized as a top or projectile game in water, and thus is useful as a bathtub toy.

Further features of the invention will become more readily apparent from the following detailed description when taken in conjunction with the accompanying drawings.

DESCRIPTION OF THE PREFERRED EMBODIMENT

Figure 1:
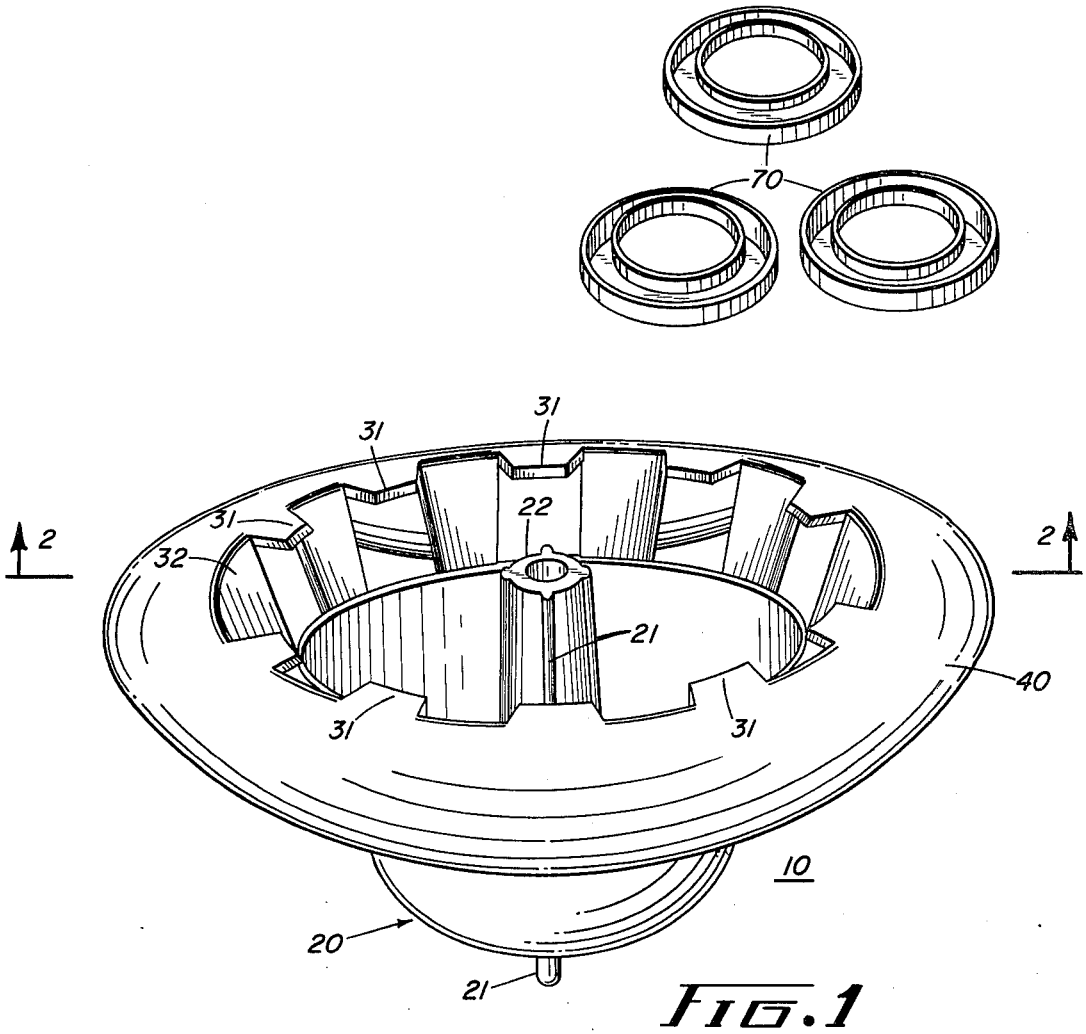
FIG. 1 is an elevational perspective view of an embodiment of the invention.

Referring to the drawings, there is shown a preferred embodiment of a combination toy top, projectile toy, and bath toy 10 in accordance with the invention. A cup-shaped receptacle 20 has a tip 21 protruding from the outer apex thereof and a central stem 22 extending upwardly from its bottom inner surface. At about the periphery of the receptacle, and preferably just below the lip thereof, a plurality of tabs 31 extend inwardly to form a retaining rim. A "brim" portion 40 is formed outside the lip of the receptacle so as to give the unit the appearance of a hat. In the present embodiment, the receptacle, tip, stem, tabs and brim are formed from an integral piece of molded plastic. During molding, the tabs 31 are pushed inwardly to leave a small slot above each tab, this being a convenient way of forming the retaining rim. A plurality of projectiles, preferably in the form of flat, annular rings 70 formed of plastic, are provided. The outer diameters of the rings are sufficiently small to fit between the stem and the tabs, and the central openings of the rings are sufficiently large to fit over the stem.

Figure 2:
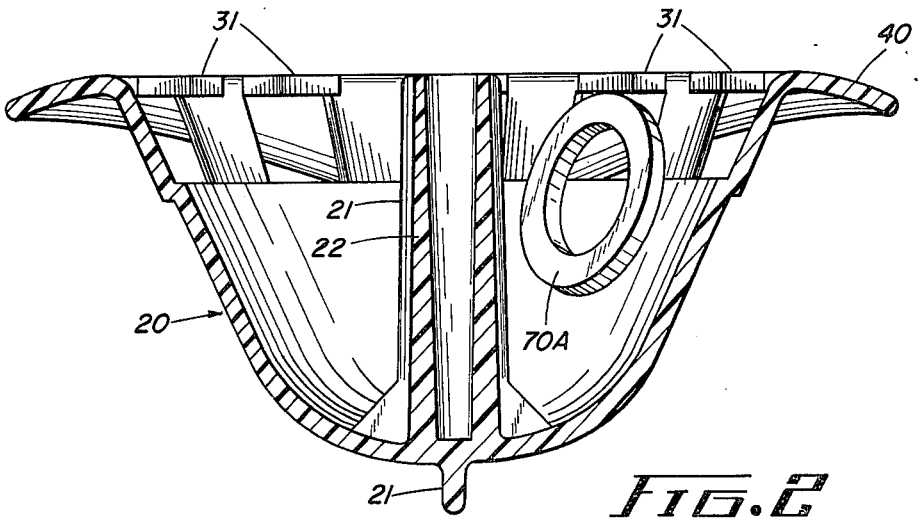
FIG. 2 is an elevational cross section, as taken along lines 2—2 in FIG. 1.

In use, the stem is rapidly twisted between the fingers and released to spin the unit 20 so that it serves as a toy top in the shape of an inverted derby hat. The stem preferably has elongated ribs 21 formed thereon which facilitate the gripping thereof to effectuate the spinning action. To use the toy as a projectile game, the rings, which are preferably provided in sets of different colors to distinguish the rings of the each player, are tossed toward the spinning receptacle. Rings which are tossed with good accuracy will be captured in the receptacle between the stem and the inner surface thereof. Centrifugal force will cause a captured ring to tend to fly out of the receptacle, but the rim formed by tabs 31 serve to retain the rings in the receptacle, as illustrated by the ring 70A of FIG. 2. To add an element of chance to the game, one or more gaps, such as shown at 32, are provided between selected tabs so that rings at particular positions within the receptacle may be ejected therefrom and not counted in the scoring of the game. Rings which are very accurately tossed will encircle the stem 22 and remain thereon.

In one form of play of the game, each player has a set of three rings of a particular color and tries to get as many of the rings as possible to land in and remain in the receptacle during a given spin of the unit. The player who is successful with the maximum number of rings wins that round of the game. An exception is that a player who "rings" the central stem is declared the winner regardless of the number of his or her rings captured in the receptacle.

As previously noted, the unit 20 is preferably formed of an integral piece of molded plastic. The plastic is preferably provided with a wall thickness to give the receptacle sufficient buoyancy to float high enough on water as to be spun in the water. A wall of thickness of about 0.1 inches of a polypropylene copolymer, for example, is suitable to insure that the unit rides sufficiently high in the water to be freely spun. This allows the toy to also be utilized as a bath "top", or as a bath projectile toy.

The invention has been described with reference to a particular embodiment, but variations within the spirit and scope of the invention will occur to those skilled in the art. For example, it will be understood that the rim tabs can be formed in various suitable ways and shapes, and that the shapes of the projectiles could also vary.

I claim:

1. A game device, comprising, in combination:

a cup-shaped receptacle having a tip protruding from the outer apex thereof and a central stem extending upwardly from the bottom inner surface thereof, said receptacle having a retaining rim which comprises a plurality of spaced tabs extending inwardly from the inner surface thereof at about the periphery thereof; and a plurality of ring projectiles having outer dimensions proportioned sufficiently small to fit between said stem and the rim of said receptacle and having central openings proportioned sufficiently large to fit over said stem;

whereby upon rapid twisting and release of said stem, said receptacle spins and projectiles accurately tossed toward said receptacle encircle said stem and are retained thereon or are captured by said receptacle and retained therein by said rim.

2. A game device, comprising, in combination:

a cup-shaped receptacle having a tip protruding from the outer apex thereof and a central stem extending upwardly from the bottom inner surface thereof, said receptacle having a retaining rim which comprises a plurality of spaced tabs extending inwardly from the inner surface thereof at about the periphery thereof, at least one gap being provided between two of said tabs;

a plurality of projectiles having outer dimensions proportioned sufficiently small to fit between said stem and the rim of said receptacle;

whereby upon rapid twisting and release of said stem, said receptacle spins and projectiles accurately tossed toward said receptacle are captured by said receptacle and retained therein by said rim, projectiles in particular positions in said receptacle being subject to ejection from said receptacle via said at least one gap.

3. The game device as defined by claim 2 wherein said receptacle, rim, and stem are integrally formed of molded plastic.

4. The game device as defined by claim 3 wherein said plastic is molded of a plastic thickness which provides sufficient buoyancy for said receptacle to be spun when floating on water.

5. The game device as defined by claim 2 wherein said projectiles are provided in sets of different colors.

6. The game device as defined by claim 3 wherein said rings are provided in sets of different colors.

* * * * *